US008136895B2

(12) United States Patent
Grainger

(10) Patent No.: US 8,136,895 B2
(45) **Date of Patent: *Mar. 20, 2012**

(54) STORAGE SYSTEM

(76) Inventor: Allan Grainger, Pen-y-Darren Park (GB)

( * ) Notice: Subject to any disclaimer, the term of this patent is extended or adjusted under 35 U.S.C. 154(b) by 0 days.

This patent is subject to a terminal disclaimer.

(21) Appl. No.: 12/913,401

(22) Filed: Oct. 27, 2010

(65) Prior Publication Data

US 2011/0036792 A1 Feb. 17, 2011

Related U.S. Application Data

(63) Continuation of application No. 11/558,050, filed on Nov. 9, 2006, now Pat. No. 8,016,370.

(60) Provisional application No. 60/809,719, filed on May 31, 2006.

(51) Int. Cl.
*A47B 87/00* (2006.01)

(52) U.S. Cl. ..... 312/111; 312/265.4; 312/330.1

(58) Field of Classification Search .... 312/265.1–265.4, 312/111, 107, 108, 330.1, 334.1, 334.6, 334.7, 312/334.14; 211/151, 162; 220/4.26, 4.24, 220/23.6, 789; 206/509, 512; 108/53.1, 108/53.5, 91, 101
See application file for complete search history.

(56) References Cited

U.S. PATENT DOCUMENTS

| | | | | | |
|---|---|---|---|---|---|
| 2,301,730 | A | * | 11/1942 | Mann | 312/293.2 |
| 2,710,784 | A | * | 6/1955 | Morin | 312/351.8 |
| 2,780,510 | A | * | 2/1957 | Cole, Jr. | 312/334.13 |
| 2,815,252 | A | * | 12/1957 | Baker | 384/23 |
| 2,891,639 | A | * | 6/1959 | Betts | 190/21 |
| 3,774,575 | A | * | 11/1973 | Patterson | 119/245 |
| 4,482,066 | A | * | 11/1984 | Dykstra | 211/151 |
| 4,932,522 | A | * | 6/1990 | Milovich | 206/308.1 |
| 6,135,299 | A | * | 10/2000 | Burgess | 211/194 |

* cited by examiner

*Primary Examiner* — Janet M Wilkens
(74) *Attorney, Agent, or Firm* — King & Schickli, PLLC

(57) ABSTRACT

A storage device includes a framework (100) comprising upper (102', 104', 106') members and lower (102, 104, 106) members connected together in a spaced-apart relationship by a plurality of struts (108). The storage device further includes a container-supporting arrangement (210) slidably mounted within the framework, the container-supporting arrangement being moveable between a retracted position configured to store a supported container within the framework, and an extended position configured to position at least part of the supported container outside the framework.

20 Claims, 3 Drawing Sheets

STORAGE SYSTEM

This application is a Continuation of U.S. application Ser. No. 11/558,050, filed Nov. 9, 2006, now U.S. Pat. No. 8,016,370 which claims the benefit of U.S. Provisional Patent Application Ser. 60/809,719, filed May 31, 2006.

FIELD OF THE INVENTION

The present invention relates to a storage system.

BACKGROUND OF THE INVENTION

Various types of heavy-duty storage containers are available. Such containers need to be versatile and capable of securely storing items, sometimes during transportation. Some containers of this type are in the form of strong drawers. As such drawers need to be capable of storing heavy items the drawers themselves are formed of rigid metal components and are, as a result, extremely heavy. Some examples can be over 90 kg (200 lbs) in weight even when empty. Such drawers are often stacked on top of each other and have their contents checked at routine intervals. If a drawer located near the top of a stack is too high to reach then it will need to be removed for checking, which means that the drawers on top of it also need to be moved. This results in a time-consuming, labour-intensive and potentially dangerous operation. There is therefore a desire for containers of this type to be made lighter, whilst remaining sufficiently strong for heavy-duty use.

SUMMARY OF THE INVENTION

According to a first aspect of the present invention there is provided a storage device including:

a framework comprising upper members and lower members connected together in a spaced-apart relationship by a plurality of struts, and a container-supporting arrangement slidably mounted within the framework, the container-supporting arrangement being moveable between a retracted position configured to store a supported container within the framework, and an extended position configured to position at least part of the supported container outside the framework.

The framework may include upper formations configured to cooperate with corresponding lower formations located on another said storage device, thereby assisting with securely stacking the storage devices. In one embodiment the struts are located at four corners of the (rectangular) framework and the upper and lower formations are located on upper and lower surfaces of each of the struts. The upper formations may comprise male members and the lower formations may comprise female members. The storage device may include further struts, e.g. located about half-way along longer members of the rectangular framework.

The container-supporting arrangement may include a first base frame configured to support the container, the first base frame being slidably mounted on a second base frame that is slidably mounted within the storage device, e.g. on at least some of the lower frame members. The second base frame may be configured to extend partly out of the framework and the first base frame may be configured to extend partly out of the second base frame, thereby assisting with preventing the storage device from de-stabilising when container-supporting arrangement is moved to the extended position.

The first base frame may include a pair of parallel elongate side members and an elongate rear member extending between the side members. The second base frame may similarly include a pair of parallel elongate side members and an elongate rear member extending between its side members. At least one of the side members of the first base frame may include at least one formation configured to cooperate with corresponding at least one formation on at least one corresponding said side members of the second base frame. The at least one formation of the side members of the first base frame may include a projection and the corresponding formation on the side member of the second base frame may include a slot. The slot may include a formation that limits movement of the projection unless sufficient force/directional movement is applied to allow the projection to move free of the limiting formation in the slot. The second base frame may be slidably mounted on at least some of the lower members of the framework. Those lower members may include a similar slot formation to cooperate with corresponding formations on the side members of the second base frame.

The rear member of the first base frame may include at least one formation configured to cooperate with at least one corresponding formation on the rear member of the second base frame. The rear member of the second base frame may include at least one formation configured to cooperate with at least one corresponding formation on a rear member of the framework. Positions of the cooperating at least one formation of the first base frame and the at least one formation of the second base frame may be offset from the cooperating at least one formation of the second base frame and the at least one formation of the rear member of the framework.

A loading end of the container-supporting arrangement may include a device configured to releasably secure a container on the arrangement. The securing device may include a moveable clasp configured to engage with a corresponding formation on the container. The clasp may be spring-loaded.

According to another aspect of the invention there is provided at least one storage device substantially as described herein and at least one container.

Whilst the invention has been described above, it extends to any inventive combination of the features set out above or in the following description. Although illustrative embodiments of the invention are described in detail herein with reference to the accompanying drawings, it is to be understood that the invention is not limited to those precise embodiments. As such, many modifications and variations will be apparent to practitioners skilled in this art. Furthermore, it is contemplated that a particular feature described either individually or as part of an embodiment can be combined with other individually described features, or parts of other embodiments, even if the other features and embodiments make no mention of the particular feature. Thus, the invention extends to such specific combinations not already described.

BRIEF DESCRIPTION OF THE DRAWING FIGURES

The invention may be performed in various ways, and, by way of example only, embodiments thereof will now be described, reference being made to the accompanying drawings, in which.

DETAILED DESCRIPTION OF THE INVENTION

Figure 1:
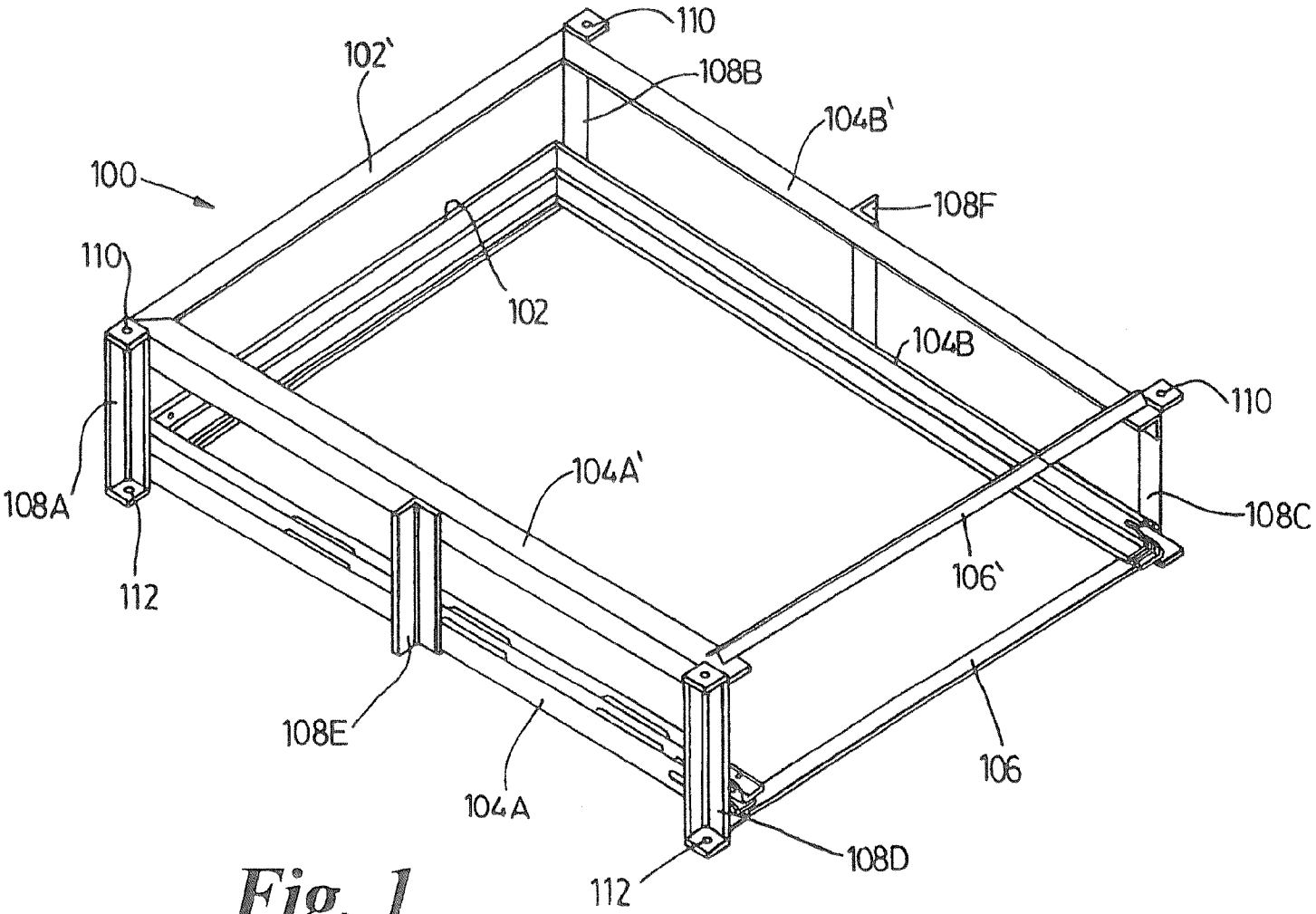
FIG. 1 is a perspective view of a framework with a container-supporting arrangement in its retracted configuration.

Referring to FIG. 1, an example of a framework 100 is shown. The framework is formed of lower frame members connected by means of a plurality of vertical struts to corresponding upper frame members. The lower frame members include a rear elongate member 102 that extends between one end of a pair of side elongate members 104A, 104B. A front elongate member 106 extends between the other end of the pair of side members. The upper frame members similarly include a rear elongate upper member 102' that extends between one end of a pair of side elongate upper members 104A', 104B'. A front elongate upper member 106' extends between the other end of the pair of upper side members. The dimensions of the corresponding members in the upper and lower frame sections generally correspond.

As can be seen, the lower 104 and upper 104' pairs of side members are of generally L-shaped cross-section, with opposing pairs of side members being oriented so as to be mirror images of each other. Thus, the front end of the framework presents an open rectangle shape. The rear lower member is also of generally L-shaped cross section, with the base of the L-shape being aligned with the bases of the L-shapes of the lower side members 104. The vertical portion of the L-shape of the lower rear member 102 is aligned with the corresponding vertical portions of the L-shapes of the side members 104, thus the vertical stem of the rear member 102 projects above the upper surfaces of the horizontal portions of the L-shapes of the lower rear and side members and can therefore act as a stop for items sliding over the lower front member and lower side members. The lower front member 106 is a substantially flat bar having an upper surface substantially aligned with the adjacent upper surfaces of the horizontal portions of the L-shapes of the lower side members 104A, 104B.

The upper rear member 102' is L-shaped in cross-section and is substantially aligned with the L-shapes of the corresponding upper surfaces of the upper side members 104A', 104B'. The upper front member 106' is formed of a bar of metal that is bent along its length at an angle of around 45° and connected to the upper surfaces of the upper side members, near their front ends. The resulting triangular member can fit into a corresponding formation on a lower surface of a container that can be placed on top of the frame 100.

The lower and upper frame members are connected together in a spaced-apart relationship by means of a plurality of vertical struts. There is a strut 108A, 108B, 108C, 108D located at each of the four corners of the rectangular lower/upper frame members. There are also two further vertical struts 108E, 108F located about half-way along the side members 104, 104'. The middle struts 108E, 108F are of L-shaped cross-section. The four corner struts 108A-108D are also of L-shaped cross-section, but include square shaped panels at their upper and lower ends. The lower panel of each corner strut includes an aperture 112. The upper surface of the upper panel of each corner strut includes a rounded projection 110, which 110 may be rubberised.

At the front end of each of the side members 104A, 104B a respective slot 106A, 106B. Each slot 106 is a V-shape rotated clockwise by 90° so that its wider portion is at the end of the side member and then tapers inwards. Each slot can include an indentation (not visible) that is intended to cooperate with a projection on the lower base frame 201 as will be described below.

It will be appreciated that the dimensions, number and arrangement of the elongate members/struts shown in the Figures is exemplary only and variations are possible. For instance, fewer than six struts could be used to connect the lower and upper frame members; the struts need not be vertical (e.g. diagonal cross-bars could be used); the general outline of the framework need not be rectangular (e.g. it could be a square box); solid panels could be used to connect the lower and upper frame members in addition to or instead of the struts (although using such to replace all of the struts would result in increased weight); the side members/struts need not be of L-shaped cross-section. In the example, a rigid metal such as steel is used for the components of the framework, but it will be understood that other strong materials (or a combination of materials) could be used instead. The dimensions of the framework may be chosen to correspond with the dimensions of a container that it is intended to support. For example, the framework could be dimensioned to accommodate a container anywhere between 380 mm-1012 mm (15"-40") wide, around 42" (1066 mm) long and 101 mm-508 mm (4"-20") high. The components of the framework can be connected together using any suitable means, e.g. welding or nuts/bolts, or the framework can be formed at least partially in another manner, e.g. using a moulding process.

Figure 2:
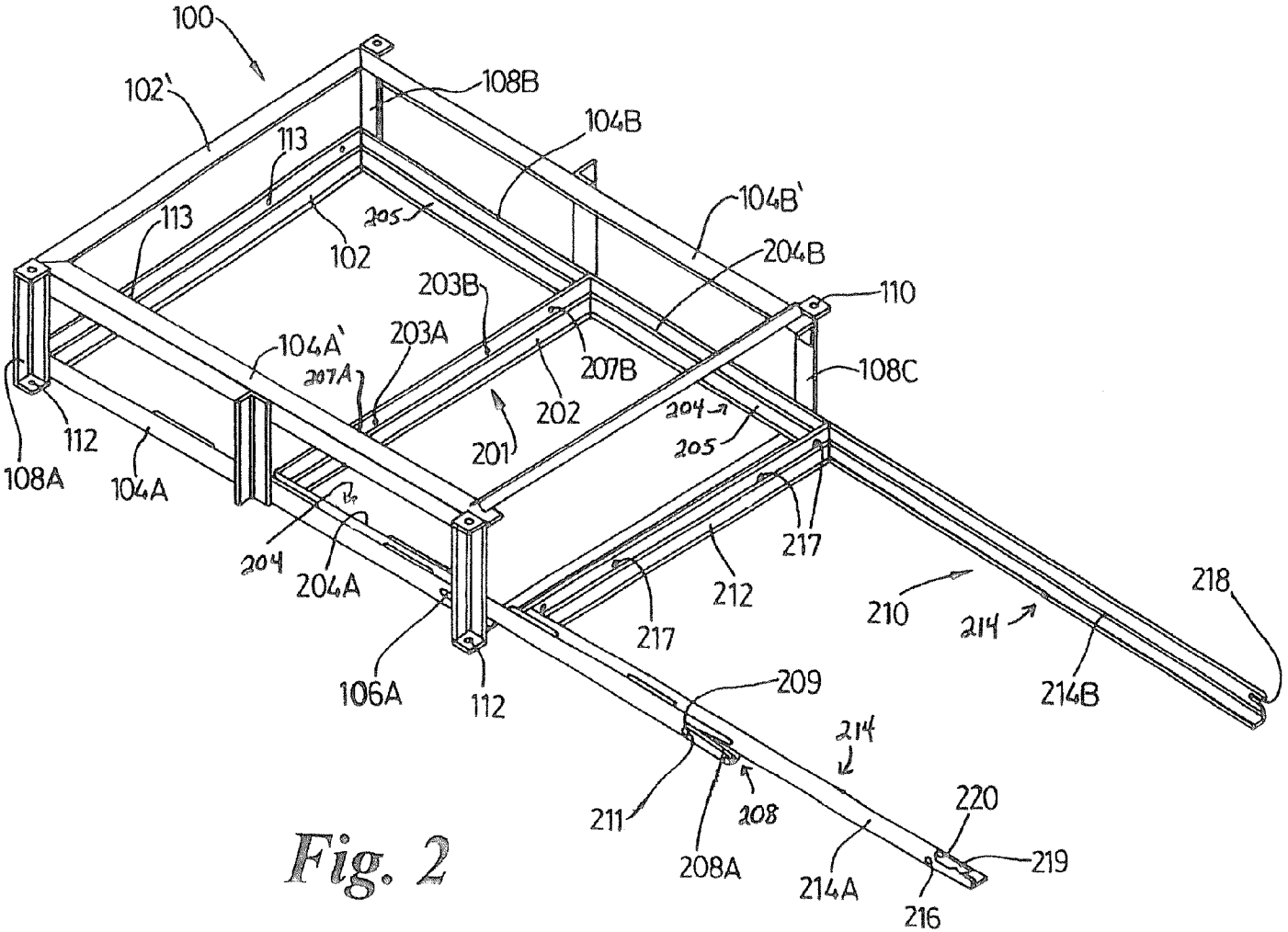
FIG. 2 is a perspective view of the framework with the container-supporting arrangement in its extended configuration.

As can best to be seen in FIG. 2, a container-supporting arrangement is slidably mounted within the framework 100. The container-supporting arrangement includes a lower base frame 201 that can slide over the upper surface of the lower front member 106 and the adjacent upper surfaces of the lower side members 104A, 104B. The container-supporting arrangement further includes an upper base frame 210 that is slidably mounted on the lower base frame 201. As will be described below, in use, a container will be placed on the upper base frame 210.

The lower base frame 201 is similar in design to certain of the lower members (e.g. 102, 104A, 104B) of the framework 100, but is slightly smaller so as to fit inside those outer lower members. The lower base frame 201 includes a rear member 202 that extends between ends of a pair of side members 204A, 204B. The rear member 202 is dimensioned to fit between the lower side members 104 of the framework 100. The side members 204 of the lower base frame 201 extend perpendicularly from the ends of the lower base frame rear member 202, towards the open front end of the framework 100. The length of each of the side members 204 of the lower base frame 201 is slightly shorter than the length of each of the lower side members 104 of the framework 100 so that the lower base frame can be substantially fully retracted inside the outer framework. The side members 204 of the lower base frame 201 are of L-shaped cross-section and oriented fit inside the L-shapes presented by the lower side members 104 of the framework 100.

The lower base frame 201 can be configured to slide on the lower members of the framework 100 using one of a variety of means. For example, discrete or continuous panels of anti-friction plastic 205 may be fitted on the inner surfaces of the lower side members 104 of the framework 100. However, it will be understood that alternative sliding means may be used, e.g. a roller/track arrangement.

At the front end of each of the side members 204A, 204B of the lower base frame 201 there is a respective slot 208A, 208B. Each slot 208 is a V-shape rotated clockwise by 90° so that its wider portion is at the end of the side member and then tapers inwards. Each slot can include an indentation 209A that is intended to cooperate with a projection (216) on the upper base frame 210 as will be described below. On the outer surface of each of the side members 204A, 204B, below the narrow end of the adjacent slot 208, there is a projection 211.

The lower base frame 201 is configured to normally only partially extend out beyond the front end of the framework 100. In the example, about half the length of the lower base frame can project beyond the front members 106, 106' of the framework. This limit on the travel of the lower base frame can be achieved in many ways, e.g. by formations (not shown) at suitable locations on the side members 204 of the lower base frame contacting the front struts 108C, 108D.

The rear member 102 of the framework 100 includes at least one formation, e.g. a pair of apertures 113. The rear member 202 of the lower base frame 201 includes at least one corresponding formation, e.g. a pair of projections (not visible in FIG. 2, but their positions are indicated on the opposite side of the member 202 by references 207A, 207B). Such projections/apertures can be either square-shaped or circular in cross-section. When the lower base frame 201 is pushed into the framework 100 so that the rear member 202 of the frame abuts (or is adjacent to) the rear member 102 of the framework then the projections 207A, 207B can enter the apertures 113, thereby limiting relative movement of the components in a vertical direction at least. The rear member 102 of the framework 100 also includes a further pair of apertures 203A, 203B, whose positions are offset from the pair 207A, 207B.

As mentioned above, an upper base frame 210 can slide over the lower base frame 201. The upper base frame 210 is similar in design to the lower base frame 201, except that its dimensions are slightly smaller to allow it to be accommodated on/within the lower base frame. The upper base frame 210 comprises a rear member numbered 212 and a pair of side members numbered 214A, 214B. The sliding mechanism used between the lower and upper base frames may be the same as (e.g. anti-friction pads 205), or different to the mechanism used to facilitate sliding of the lower base frame on the lower parts of the framework 100.

Projections 216 are located on the outer surfaces of the side members 214. When the upper base frame 210 is pushed fully back over the lower base frame 201, these projections fit into the slots 208. The indention 209 in the slots means that considerable force (in the frontwards direction) needs to be applied to release the projections. In a similar manner, the side projections 211 on the side members of the lower base frame 201 can engage with the slots 106 on the sides of the frame side members 104.

The rear member 212 of the upper base frame 210 includes a pair of projections (not visible in FIG. 2, but their positions are indicated on the opposite (front) surface of the member 212 by references 217). The projections 217 are positioned so as to be engageable with the apertures 203 in the rear member 202 of the lower base frame 201.

The front ends of the side members 214 of the upper base frame 210 also include similar tapering slots 218. The front ends each further include a respective contoured clasp member 219 that is connected to the outer surface of the side members 214 by means of a respective pivot 220. The clasp member 219 is biased, e.g. by means of a spring, to a "closed" position, i.e. a position in which the clasp blocks the inner end of the slot 218, thereby preventing any member located therein from escaping unless the clasp is deliberately moved clear. The upper base frame 201 is configured to normally only partially extend out beyond the front end of the lower base frame 201. In the example, about half the length of the upper base frame can project beyond the front of the lower base frame. This limit on the travel of the upper base frame can be achieved in many ways, e.g. by formations (not shown) at suitable locations on the side members 214 of the upper base frame contacting corresponding formations at/near the front ends of the side members 204 of the lower base frame 201.

In use, the upper base frame 210 is pulled out of the front of the framework 100 until its travel on the lower base frame 201 is limited. Next, the lower base frame 210 can slide out over the lower members 104 of the framework until its travel is also arrested. At this point the upper front base frame 210 will normally be extended out of the framework 100, as illustrated in FIG. 2. A container (having a generally rectangular base dimensioned to be supported on/by the upper base frame 210) can then be placed on the horizontal portions of the L-shapes of the rear 212 and side 214A, 214B members of the upper base frame 210. This normally involves sliding at least the front end of the container towards the back rear member 212 of the upper base frame. Suitable formations on the container then push the clasp members 219 on each of the side members 214 upwards (or this can be done manually/mechanically) against the bias to allow the container formations to move towards the tapered ends of the slots 218. Once each of the container formations pass beyond a certain point, contact with the underside of the clasp member 219 is broken (or the clasp can be released) and the clasp moves down, limiting the travel of the container formation in a frontwards direction. Thus, the container is releasably secured on the upper base frame 210.

The container-supporting arrangement can then be slid to the storage position within the framework. The upper base frame 210 can be slid over the lower base frame 201 until the projections 216 on the side members 214 of the upper frame move to the end of the slots 208 in the side members 204 of the lower frame. The rear projections 217 and apertures 203 on the two base frames can also engage at this point. The lower frame 201 can then normally still slide over the front 106 and side members 104, until the side projections 211 reach the narrow end of the slots 106 in the lower side members 104 and the rear projections/apertures of the lower base frame 201 and the lower framework members engage. To remove the container from the device the reverse operation can be performed. Of course, the container does not need to be completely removed from the framework, unless desired, and the container-supporting arrangement can just be slid to the extended position, allow the container to be used like a drawer.

Figure 3:
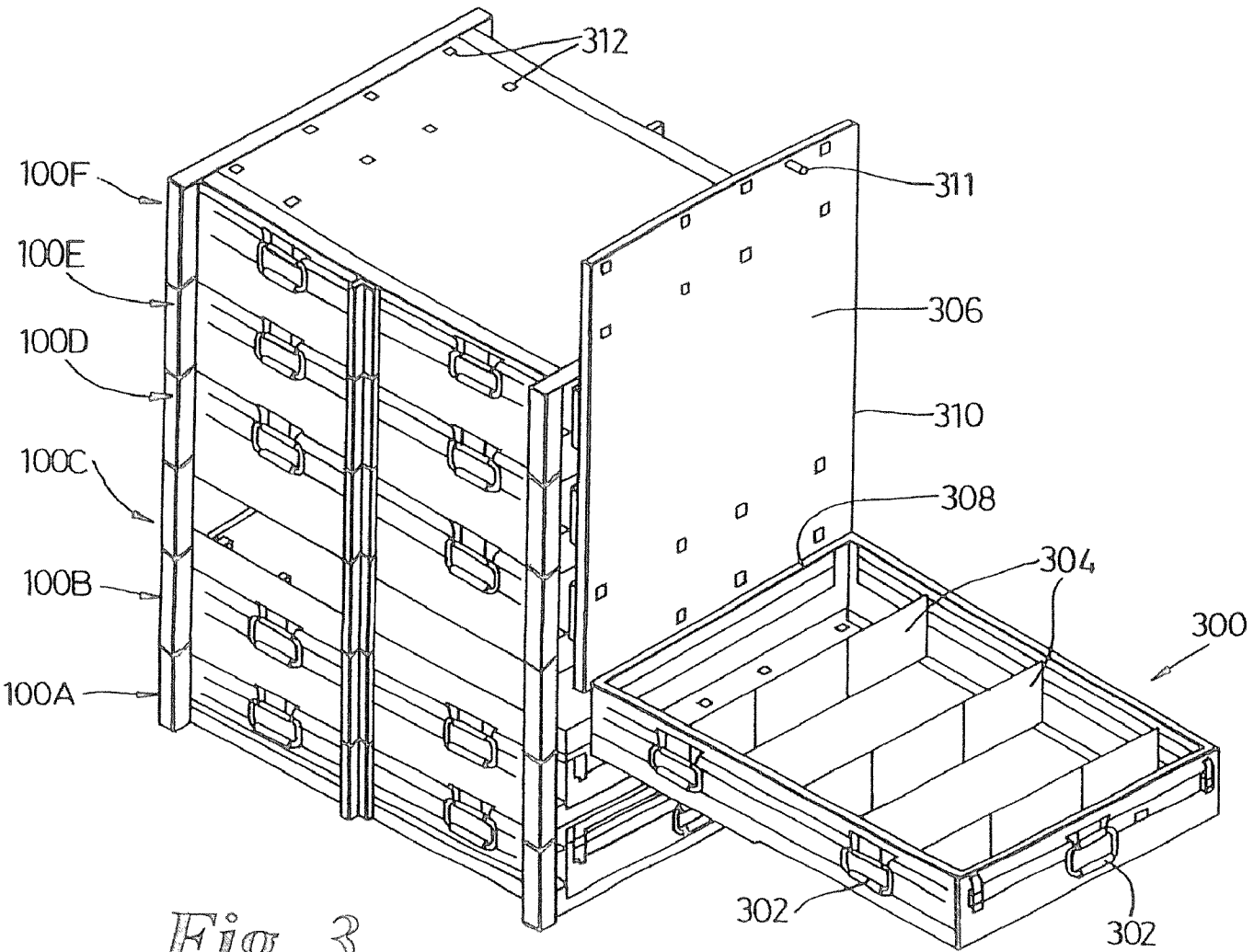
FIG. 3 is view of a plurality of frameworks stacked together and supporting respective containers.

FIG. 3 shows how several of the frameworks can be stacked on top of each other, facilitated by the corner projections 110 of a lower framework engaging the corner apertures 112 of the framework directly above it. In the example there are six frameworks 100A-100F (each storing a respective container) in the stack.

The third framework 1000 from the bottom is shown with its container-supporting arrangement in the extended position. An example of a suitable container 300 is also shown. The container is a generally rectangular box comprising a pair of end walls, a pair of side walls and a base. One or more carrying handles 302 may be present on one or more of the side and/or end walls. Partitions 304 can (optionally) be fitted inside the container. The container 300 may be fitted with a lid 306, which may be connected to it by means of a hinge 308. The lid 306 can have a lip 310 around at least some of its edges. In some cases a bulb seal may be formed on the lid so as to make the container watertight. Hasps 311 or other closing mechanisms may also be provided to securely shut the lid. The upper surface of a container can include at least one formation 312 that can cooperate with at least one corresponding formation (not visible) on the lower surface of another container, thereby assisting with stacking the containers directly on top of each other. The lower surface of the container may be fitted with rubber pads (not visible) that can reduce vibration and/or reduce metal-to-metal contact (additionally or alternatively, such pads can be provided on surfaces of the upper base frame 210 at least).

The storage system described above can offer a heavy-duty solution, but the use of a "skeleton" framework instead of a solid box-like outer container for an inner container means that the overall weight of the system is significantly reduced. The system also has the added advantage of allowing containers to be removed more easily, e.g. when they are stacked.

I claim:

1. A storage device for storing a container including:

a framework comprising upper members and lower members connected together in a spaced-apart relationship by a plurality of struts, and a container-supporting arrangement slidably mounted within the framework configured to support a box-shaped container, said container supporting arrangement including a loading end having a moveable clasp configured to engage with a corresponding formation on the container, in use, the container-supporting arrangement being moveable between a retracted position configured to store the container within the framework, and an extended position configured to position at least part of the container outside the framework, wherein upper surfaces of at least some of the struts of the framework include upper formations configured to cooperate with corresponding lower formations located on another storage device, thereby assisting with securely stacking the storage device and the another storage device, and further including means for reducing friction provided on at least one of the upper and lower members of the framework.

2. A storage device according to claim 1, wherein the friction-reducing means comprises one or more plastic panels.

3. A storage device according to claim 1, including a set of said struts located at four corners of the framework and wherein the upper and lower formations are located on upper and lower surfaces of each of the struts.

4. A storage device according to claim 3, wherein including further struts located about half-way along longer elongate members of the framework.

5. A storage device according to claim 1, wherein the upper formations comprise male members and the lower formations comprise female members.

6. A storage device according to claim 1, wherein the container-supporting arrangement includes a first base frame configured to support the container, the first base frame being slidably mounted on a second base frame that is slidably mounted within the framework.

7. A storage device according to claim 6, wherein the second base frame is configured to extend partly out of the framework and the first base frame is configured to extend partly out of the second base frame, thereby assisting with preventing the storage device from de-stabilizing when the container-supporting arrangement is moved to the extended position.

8. A storage device according to claim 7, wherein the first base frame includes a pair of parallel elongate side members and an elongate rear member extending between the side members.

9. A storage device according to claim 8, wherein at least one of the side members of the first base frame includes at least one formation configured to cooperate with corresponding at least one formation on at least one corresponding said side members of the second base frame.

10. A storage device according to claim 9, wherein the at least one formation of the side members of the first base frame includes a projection and the corresponding formation on the side member of the second base frame includes a slot.

11. A storage device according to claim 10, wherein the slot includes a formation that limits movement of the projection unless sufficient force or directional movement is applied to allow the projection to move free of the limiting formation in the slot.

12. A storage device according to claim 8, wherein the second base frame is slidably mounted on at least some of the lower members of the framework.

13. A storage device according to claim 12, wherein the lower members includes a slot formation configured to cooperate with corresponding formations on side members of the second base frame.

14. A storage device according to claim 8, wherein the rear member of the first base frame includes at least one formation configured to cooperate with at least one corresponding formation on the rear member of the second base frame.

15. A storage device according to claim 14, wherein the rear member of the second base frame includes at least one formation configured to cooperate with at least one, corresponding formation on a rear member of the framework.

16. A storage device according to claim 15, wherein positions of the at least one formation of the first base frame and the cooperating at least one formation of the second base frame are offset from the at least one formation of the second base frame and the cooperating at least one formation of the rear member of the framework.

17. A storage device for a container including:

a framework comprising upper members and lower members connected together in a spaced-apart relationship by a plurality of struts, and a container-supporting arrangement slidably mounted within the framework configured to support a box-shaped container, said container supporting arrangement including a loading end having a moveable clasp configured to engage with a corresponding formation on the container, in use, the container-supporting arrangement being moveable between a retracted position configured to store the container within the framework, and an extended position configured to position at least part of the container outside the framework, wherein upper surfaces of at least some of the struts of the framework include upper formations configured to cooperate with corresponding lower formations located on another storage device, thereby assisting with securely stacking the storage device and the another storage device, and a plastic panel provided on one of the upper or lower members of the framework for reducing friction with the container-supporting arrangement.

18. A storage device comprising:

a framework comprising upper members and lower members connected together in a spaced-apart relationship by a plurality of struts, wherein upper surfaces of at least some of the struts of the framework include upper formations configured to cooperate with corresponding lower formations located on another storage device, thereby assisting with securely stacking the storage device and the another storage device;

a container support including a loading end slidably mounted within the framework;

means for reducing friction between the framework and the container support;

a box-shaped container including at least one formation for attaching to the container support; and a device associated with the loading end of the container support, said device configured to releasably secure the box-shaped container, wherein said device includes a moveable clasp configured to engage with the formation on the container;

wherein the container support is moveable between a retracted position configured to store the container within the framework, and an extended position configured to position at least part of the box-shaped container outside the framework.

19. A storage device including:

a framework comprising upper members and lower members connected together in a spaced-apart relationship by a plurality of struts, a container-supporting arrangement comprising a first base frame including a first pair of parallel elongate side members and an elongate rear member extending between the side members, and a second base frame including a second pair of elongate side members, the first base frame configured to support a container, and said first base frame being slidably mounted on the second base frame that is slidably mounted within the framework, in use, the container-supporting arrangement being moveable between a retracted position configured to store the container within the framework, and an extended position configured to position at least part of the container outside the framework; and at least one projection associated with at least one side member of the first base frame, said projection configured to cooperate with at least one slot associated with at least one side member of the second base frame;

wherein the second base frame is configured to extend partly out of the framework and the first base frame is configured to extend partly out of the second base frame, thereby assisting with preventing the storage device from de-stabilizing when the container-supporting arrangement is moved to the extended position; and wherein upper surfaces of at least some of the struts of the framework include upper formations configured to cooperate with corresponding lower formations located on another storage device, thereby assisting with securely stacking the storage device and the another storage device, and further including means for reducing friction provided on at least one of the upper and lower members of the framework.

20. A storage device including:

a framework comprising upper members and lower members connected together in a spaced-apart relationship by a plurality of struts, and a container-supporting arrangement comprising a first base frame including a loading end, said first base frame configured to support a box-shaped container, and further comprising a second base frame, wherein the first base frame is slidably mounted on the second base frame and the second base frame is slidably mounted within the framework, and a device associated with the loading end of the first base frame configured to releasably secure the box-shaped container, said device including a moveable clasp configured to engage with a corresponding formation on the container;

wherein the container-supporting arrangement is moveable between a retracted position configured to store the container within the framework, and an extended position wherein the second base frame extends partly out of the framework and the first base frame extends partly out of the second base frame, such that the container is fully extendable out of the framework; and wherein upper surfaces of at least some of the struts of the framework include upper formations configured to cooperate with corresponding lower formations located on another storage device, thereby assisting with securely stacking the storage device and the another storage device, and further including means for reducing friction provided on at least one of the upper and lower members of the framework.

* * * * *